US005950691A

United States Patent [19]

Abe et al.

[11] Patent Number: 5,950,691

[45] Date of Patent: Sep. 14, 1999

[54] HIGH-SPEED LIQUID FILLING MACHINE

[75] Inventors: Kazuo Abe; Hiroshi Kitajima; Masakatsu Kondo; Michio Ueda, all of Tokushima, Japan

[73] Assignee: Shikoku Kakoki Co., Ltd., Tokushima, Japan

[21] Appl. No.: 09/003,373

[22] Filed: Jan. 6, 1998

[30] Foreign Application Priority Data

Jan. 8, 1997 [JP] Japan ..... 9-001491

[51] Int. Cl.[6] ..... B65B 1/04

[52] U.S. Cl. ..... 141/103; 141/183; 141/67

[58] Field of Search ..... 141/102, 103, 141/129, 156–162, 183, 184, 67

[56] References Cited

U.S. PATENT DOCUMENTS

| | | | |
|---|---|---|---|
| 3,648,741 | 3/1972 | Crossdale | 141/103 |
| 3,702,625 | 11/1972 | Schmidt | 141/103 |
| 4,537,230 | 8/1985 | Schindel | 141/146 |

FOREIGN PATENT DOCUMENTS

| | | |
|---|---|---|
| 0 100 481 | 7/1983 | European Pat. Off. . |
| 0 579 334 B1 | 7/1993 | European Pat. Off. . |
| 6-10108 | 2/1994 | Japan . |
| A-8-48393 | 2/1996 | Japan . |
| 1 140 888 | 5/1966 | United Kingdom . |
| WO 94 20365 | 9/1994 | WIPO . |

*Primary Examiner*—Steven O. Douglas

*Attorney, Agent, or Firm*—Armstrong, Westerman, Hattori, McLeland & Naughton

[57] ABSTRACT

A high-speed liquid filling machine comprises a conveyor 11 for transporting containers C so as to stop the containers successively at a primary filling station S1 and at secondary filling station S2, a primary filling device 21 and a secondary filling device 22 arranged at the primary and secondary filling stations S1, S2 respectively, a supply device for supplying the same kind of liquid to be filled into the primary and secondary filling devices 21, 22, and a control device for controlling the amount to be filled in by the primary filling device 21 and the amount to be filled in by the secondary filling device 22 so that the combined amount to be filled in by the devices 21, 22 is equal to the capacity of each of the containers.

7 Claims, 3 Drawing Sheets

HIGH-SPEED LIQUID FILLING MACHINE

BACKGROUND OF THE INVENTION

The present invention relates to a high-speed filling machine for filling a liquid, such as juice or milk, into containers at a high speed.

Liquid filling machines are already known which comprise a machine frame having a filling station, a conveyor for transporting containers so as to successively stop them at the filling station, a filling device disposed at the station, and means for supplying the liquid to be filled into the device.

Also known, as such machines, are a packaging machine having two filling stations along a container transport path (Unexamined Japanese Utility Model Publication No. 10108/1994), and an apparatus for practicing a method of filling a liquid of high viscosity, such as adhesive or sealing material, into containers with high accuracy without necessitating an increased time, by using two filling stations (JP-A-48393/1996).

It appears possible to improve filling machines in the filling capacity by making the machine operable at a higher speed. The higher speed shortens the operating cycle of the machine to reduce the filling time per container, consequently giving rise to a need to fill the liquid into the container within the reduced time in an amount corresponding to the capacity of the container. It then becomes necessary to fill the liquid at an increased flow rate, which entails the problem that the liquid will bubble up or form a disturbed surface within the container. For this reason, it has been difficult to operate the machine at an increased speed.

The liquid filling-packaging machine disclosed in the foregoing publication No. 10108/1994, although having the primary and secondary filling devices, is not provided with supply means for supplying the same liquid to be filled into the two filling devices, nor has the machine control means for controlling the amount to be filled in by the primary device and the amount to be filled in by the secondary device so that the combined amount to be filled in by the two devices is equal to the capacity of the container. The machine is therefore useful when two kinds of liquids are to be separately filled into each container, whereas the machine is not usable for operation at a higher speed.

With the apparatus of JP-A-48393 adapted to fill a highly viscous liquid into containers with high accuracy, a primary channel and a secondary channel for feeding the liquid respectively to the primary filling station and the secondary filling station therethrough are set at a flow rate ratio of 90:10 to 99.5:0.5, preferably 99:1, such that a very small amount of the liquid is slowly filled in at the secondary station to accurately compensate for a deficiency in the contents of the container which has been filled at the primary station approximately to a specified amount. However, the apparatus requires means for detecting the amount filled in to accurately compensate for the deficiency in the contents of the container filled approximately to the specified amount at the primary station. Furthermore, it is required that the container stopped by an intermittent drive conveyor be held completely at a halt to eliminate the disturbance of the liquid surface therein for the accurate detection of the amount of liquid filling the container. Although adapted to accurately fill containers with the specified amount of contents, the apparatus is unable to accurately fill the specified amount of liquid into the containers at a higher speed.

SUMMARY OF THE INVENTION

An object of the present invention is to provide a machine for filling containers with a specified amount of liquid accurately at a high speed free of the problem of bubbling or disturbance of liquid surface within the container.

We have conducted intensive research to overcome the foregoing problems and accomplished the present invention.

The present invention provides a high-speed liquid filling machine comprising a machine frame having a primary filling station and a secondary filling station, a conveyor for transporting containers so as to stop the containers successively at the primary filling station and at the secondary filling station, a primary filling device and a secondary filling device arranged at the primary and secondary filling stations respectively, supply means for supplying the same kind of liquid to be filled in to the primary and secondary filling devices, and control means for controlling the amount to be filled in by the primary filling device and the amount to be filled in by the secondary filling device so that the combined amount to be filled in by the devices is equal to the capacity of each of the containers.

The filling machine of the present invention is adapted to fill a specified amount of liquid into containers accurately at a high speed without entailing the problem of bubbling or disturbance of the liquid surface within the container.

The invention further provides a high-speed liquid filling machine of the type described above wherein each of the primary and secondary filling devices comprises a filling nozzle disposed above a path of transport of the container, a metering cylinder housing a piston for feeding the liquid to the filling nozzle by the reciprocating movement of the piston, and an independent drive device for reciprocatingly moving the piston over a desired stroke length and/or at a desired speed.

The invention further provides a high-speed liquid filling machine of the type described wherein the drive device comprises a motor and an operating mechanism for transmitting the rotation of an output shaft of the motor to the piston upon converting the rotation into a linear reciprocating motion, and the control means provides control by varying set pulse values of the motors of the respective filling devices.

The invention further provides a high speed liquid filling machine of the type described wherein the amount to be filled in by the primary filling device is 50 to 80% of the capacity of the container, and the amount to be filled in by the secondary filling device is 50 to 20% of the container capacity.

DESCRIPTION OF THE PREFERRED EMBODIMENT

Figure 1:
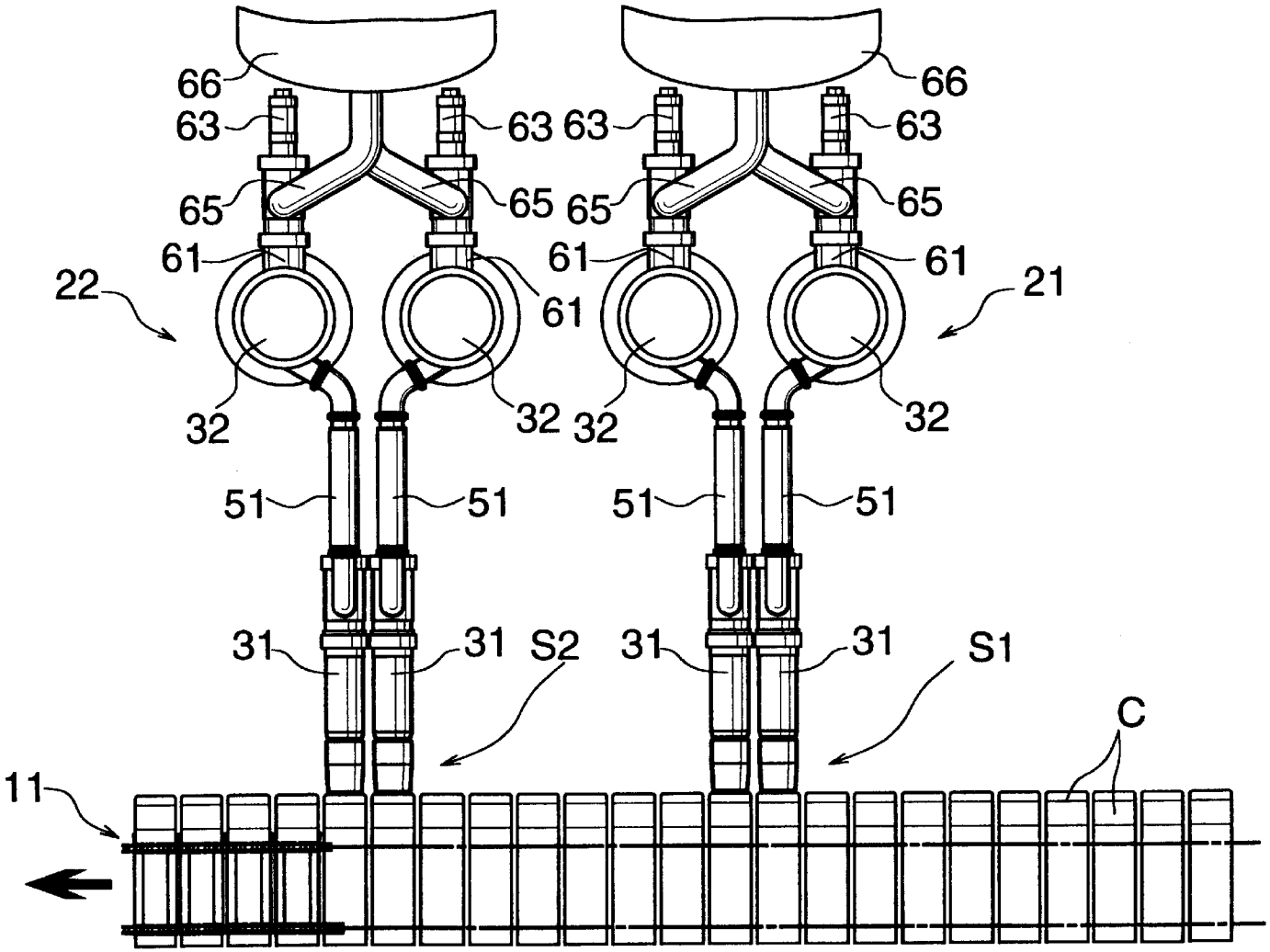
FIG. 1 is a side elevation of a high-speed liquid filling machine embodying the invention.
Figure 2:
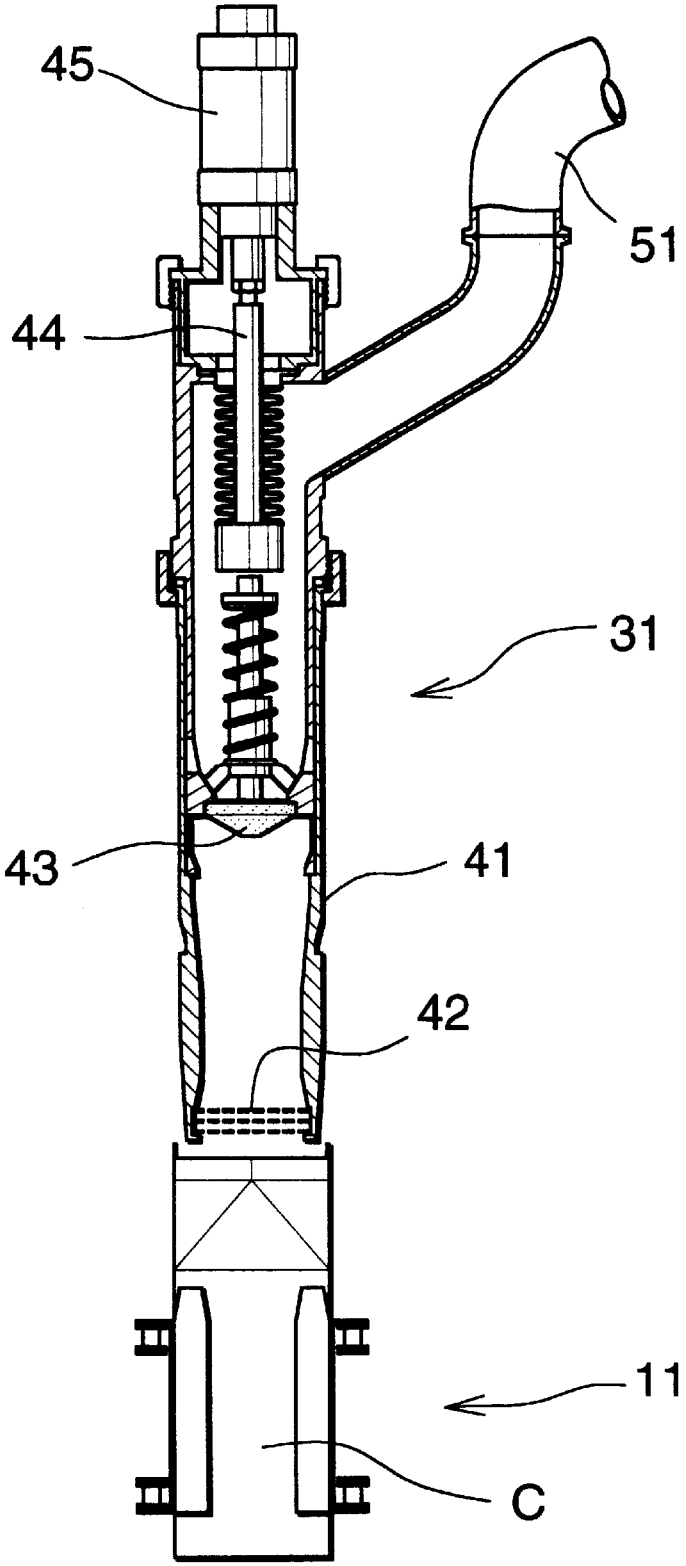
FIG. 2 is a view in vertical longitudinal section of a filling nozzle included in the machine.
Figure 3:
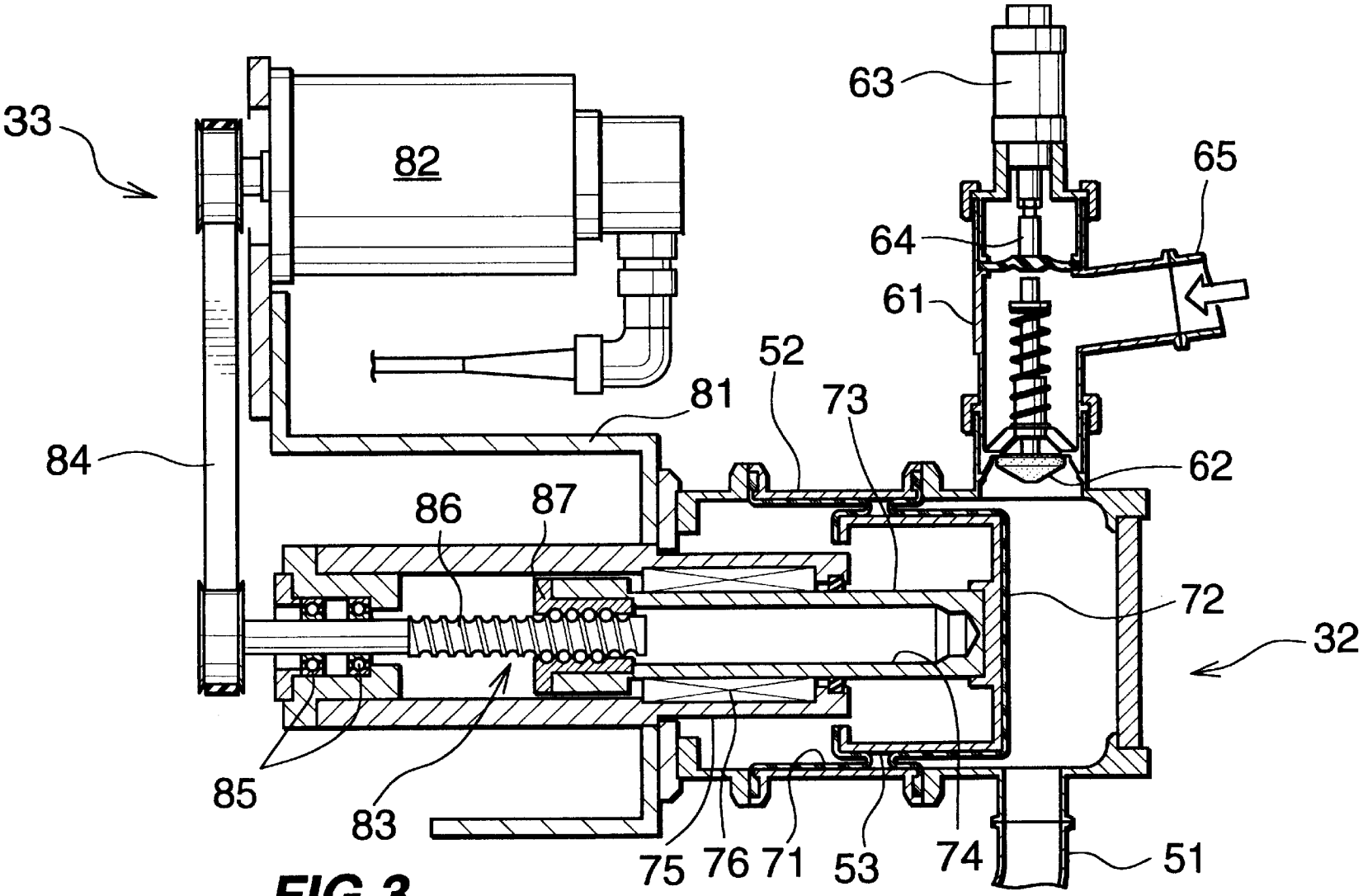
FIG. 3 is a view in vertical section of a metering cylinder included in the machine.

An embodiment of the present invention will be described below in detail with reference to the drawings.

The illustrated high-speed liquid filling machine comprises an intermittent drive conveyor 11 having a transport path extending through a primary filling station S1 and then through a secondary filling station S2, and a primary filling device 21 and a secondary filling device 22 arranged at the stations S1 and S2, respectively.

Paper containers each in the form a tube having a bottom and a square cross section are transported as arranged in a row on the conveyor 11 a distance at a time by each cycle of operation thereof which distance corresponds to two container pitches, whereby two containers are brought to and stopped at each of the stations S1, S2 at the same time.

The primary and secondary filling devices 21, 22 are of the same construction. The primary filling device 21 will be described below.

The primary filling device 21 comprises two filling nozzles 31 arranged above the container transport path at the primary filling station S1, two metering cylinders 32 for feeding a specified amount of the liquid to be filled in to the respective nozzles 31, and two operating mechanisms 33 provided for the respective cylinders 32. The two nozzles 31, metering cylinders 32 or operating mechanisms 33 are identical in construction.

The filling nozzle 31 comprises a vertical tubular nozzle body 41, wire netting 42 attached to an open lower end of the nozzle body 41 for preventing the liquid from flowing down under gravity, an outflow check valve 43 provided in the nozzle body 41 at an intermediate portion of its height, and a fluid-pressure cylinder 45 mounted on the upper end of the nozzle body 41, facing vertically downward and having a piston rod 44 movable into pushing contact with the valve stem of the check valve 43 to open the valve 43, for example, for cleaning.

The metering cylinder 32 comprises a horizontal cylinder body 52 connected to the nozzle body 41 by a connecting pipe 51 and having a closed right end, and a piston 53 housed in the cylinder body 52.

The cylinder body 52 has a vertical inlet pipe 61 connected to an upper end thereof. An inflow check valve 62 is housed in the inlet pipe 61. Mounted on the upper end of the inlet pipe 61 is a fluid-pressure cylinder 63 facing vertically downward for opening the valve 62. The cylinder 63 has a piston rod 64 provided with a diaphragm at its lower end and movable into pushing contact with the valve stem of the check valve 62 to open the check valve 62. A supply pipe 65 has an outlet end connected to the inlet pipe 61 at an intermediate portion of its height and an inlet end connected to a liquid tank 66.

A pair of left and right diaphragms 71 and 72 close a clearance provided inside the cylinder body 52 around the piston 53.

The piston 53 has a top wall having connected thereto the right end of a horizontal piston rod 73, which is formed with an axial bore 74 having an open left end. A guide sleeve 75 is fitted around the piston rod 73 with a slide bush 76 interposed therebetween.

The operating mechanism 33 comprises a servomotor 82 facing leftward and attached to the left end of the cylinder body 52 by a bracket 81, and a ball screw 83 for transmitting the rotation of the servomotor 82 to the piston rod 73 upon converting the rotation to a linear reciprocating motion. The ball screw 83 comprises a threaded rod 86 connected to the output shaft of the servomotor 82 by a belt 84 and supported by bearings 85 on the guide sleeve 75, and a nut 87 fixed to the open end of the axial bore 74 of the piston rod 73.

The same liquid to be filled in is supplied to the liquid tanks 66 of the primary and secondary filling devices 21, 22 through an unillustrated pipeline. A washing liquid is supplied through the pipeline to the filling devices 21, 22. In this case, the fluid-pressure cylinders 45, 63 are operated to forcibly open the outflow and inflow check valves 43, 62, respectively.

The servomotor 82, when rotated forward and reversely, reciprocatingly moves the piston 53 leftward and rightward. When the piston 53 is moved leftward, the inflow check valve 62 is opened, permitting the liquid to flow into the metering cylinder 32 from the tank 66. The rightward movement of the piston 53 then opens the outflow check valve 43, forcing the liquid into the nozzle 31 from the metering cylinder 32 and discharging the liquid from the nozzle 31 in an amount corresponding to the amount forced in.

The amount filled in per cycle is in proportion to the stroke length of the piston 31. The flow rate for filling is in proportion to the stroke length and/or the speed of stroke of the piston 53. The desired stroke length and speed of the piston 53 are obtained by varying the set pulse value of the servomotor 82.

Although the servomotors are used for driving the primary and secondary filling devices, the drive source is not limited to this type of motor but can be a motor, such as a pulse motor, which is operable by pulses from a control device. Other motors are also usable when provided with means for detecting, for example, the angle of rotation of the motor or the amount of movement of the piston.

As described above, it is desired that the primary and second filling devices for use in the invention each comprise a filling nozzle disposed above the container transport path, a metering cylinder housing a piston for feeding the liquid to be filled into the nozzle by the reciprocating movement of the piston, and an independent drive device for reciprocatingly moving the piston over an optional stroke length and/or at an optional stroke speed.

Further according to the invention, the drive device for use in each of the primary and secondary filling devices comprises a motor and an operating mechanism for transmitting the rotation of the output shaft of the motor to the piston upon converting the rotation to a linear reciprocating motion. Preferably the control means for controlling the filling devices provides control by varying the set pulse value of the motor for each of the filling devices.

In the case where the motor serves as the drive device, the motor is set at a specified pulse value, whereby desired values can be determined easily as the amount to be filled in by the filling device, filling time and filling amount ratio between the primary and secondary filling devices. Further the filling amount ratio can be determined within a short time. Accordingly, the machine can be operated at a high speed optimally in conformity with the properties of the liquid to be filled in.

With the high-speed liquid filling machine of the invention, the same liquid is filled into a single container by the primary and secondary filling devices individually, in an amount less than the capacity of the container by each device. Consequently, the filling time can be shortened without necessity of increasing the filling flow rate, so that the machine can be operated at a high speed, for example, for filling at least 12000 containers per hour without entailing the problem of bubbling up or disturbances in the liquid surface within the container.

In the case where the ratio between the amounts to be filled in respectively by the primary and secondary filling devices is to be controlled by the control means according to the invention, the amount to be filled in by the primary device can be 50 to 80% of the capacity of the container, and the amount to be filled in by the secondary device 50 to 20% of the container capacity, the amounts being determined in accordance with the properties of the liquid.

For example, when the liquid has a low viscosity like a cooling beverage, the flow rate of the liquid to be filled in by the secondary device needs to be higher than the flow rate of the liquid to be handled by the primary device and is then likely to permit the liquid to bubble up or form a disturbed surface in the vicinity of the container opening, if the amount to be filled in is smaller by the primary device than by the secondary device. Further when the amount to be filled in by the primary device is in excess of 80%, the machine cannot be operated at a higher speed even if the rate of the flow through the primary device is increased to the greatest possible extent. Accordingly, it is desired that the amount to be filled in by the primary device be 50 to 80% of the capacity of the container, and that the amount to be filled in by the secondary device be 50 to 20% of the container capacity.

In the case where the liquid is more liable to bubble up or become disturbed on the surface than cooling beverages, like milk, the flow rate of the liquid to be filled in by the secondary device must be lower than the flow rate of the liquid to be handled by the primary device, while the rate of the flow through the primary device cannot be greatly increased. It is therefore desirable that the amount to be filled in by the primary device be 60 to 70% of the capacity of the container, and that the amount to be filled in by the secondary device be 40 to 30% of the container capacity.

An actual machine was tested with the following result. The machine was adapted to transport containers in two rows (a single row in the case of the illustrated machine) a distance, corresponding to two container pitches, at a time. The containers used were 70 mm square in cross section and 1000 cc in capacity. The liquid filled in was milk.

The primary filling device 21 filled 670 cc of milk into each container, and the secondary filling device 22 filled the remainder, i.e., 330 cc. The machine filled 16000 containers/hour. When a conventional machine having a single filling device was used under the same conditions as above, the filling capacity was limited to 12000 containers/hour. The primary and secondary filling operations conducted therefore achieved an improvement of about 33% in filling capacity.

What is claimed is:

1. A high-speed liquid filling machine comprising:

a machine frame having a primary filling station and a secondary filling station, a conveyor for transporting containers, means for stopping the containers successively at the primary filling station and at the secondary filling station, a primary filling device and a secondary filling device arranged at the primary and secondary filling stations, respectively, supply means for supplying the same kind of liquid to the primary and secondary filling devices, and control means for controlling the amount of liquid to be supplied to the primary filling device and the amount to be supplied to the secondary filling device so that the combined amount to be filled in by the devices is equal to the capacity of each of the containers, said control means including with respect to each of said primary filling device and said secondary filling device:

a metering cylinder containing a piston mounted for reciprocal movement therein, a motor operatively connected to said piston for moving said piston in alternate extended or retracted directions in response to set pulse values of rotation of said motor, a supply line connected to said metering cylinder and having a normally closed inflow valve disposed therein which is openable upon retraction of said piston to admit liquid to said metering cylinder, and a connecting pipe connected to said metering cylinder and having a normally closed outflow valve which is openable upon extension of said piston to discharge liquid from said metering cylinder to a filling device.

2. A high-speed liquid filling machine according to claim 1 wherein each of the primary and secondary filling devices comprises a filling nozzle disposed above a path of transport of the container, and an independent drive device for reciprocatingly moving the piston in said metering cylinder over a desired stroke length and/or at a desired speed.

3. A high-speed liquid filling machine according to claim 2 wherein the drive device comprises a servo-motor and an operating mechanism for transmitting the rotation of an output shaft of the servo-motor to the piston upon converting the rotation into a linear reciprocating motion, and the control means provides control by varying set pulse values of the motors of the respective filling devices.

4. A high-speed liquid filling machine according to any one of claims 1 to 3 wherein the amount to be filled in by the primary filling device is 50 to 80% of the capacity of the container, and the amount to be filled in by the secondary filling device is 50 to 20% of the container capacity.

5. A high-speed liquid filling machine according to claim 4 wherein the amount per unit time to be filled in by the secondary filling device is smaller than the amount per unit time to be filled in by the primary filling device.

6. A high-speed liquid filling machine according to claim 4 wherein the amount per unit time to be filled in by the secondary filling device is smaller than the amount per unit time to be filled in by the primary filling device.

7. A high-speed liquid filling machine according to any one of claims 1 to 3 wherein the amount to be filled in by the primary filling device is 60 to 70% of the capacity of the container, and the amount to be filled in by the secondary filling device is 40 to 30% of the capacity of the container.

* * * * *